US011342668B2

(12) United States Patent
Chen et al.

(10) Patent No.: US 11,342,668 B2
(45) Date of Patent: May 24, 2022

(54) CELLULAR COMMUNICATION SYSTEMS HAVING ANTENNA ARRAYS THEREIN WITH ENHANCED HALF POWER BEAM WIDTH (HPBW) CONTROL

(71) Applicant: CommScope Technologies LLC, Hickory, NC (US)

(72) Inventors: HongHui Chen, Suzhou (CN); Peter J. Bisiules, LaGrange Park, IL (US); Bin Sun, Suzhou (CN); YueMin Li, Suzhou (CN); Xia Mei, Suzhou (CN); Martin L. Zimmerman, Chicago, IL (US); Haifeng Li, Suzhou (CN); Long Shan, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 182 days.

(21) Appl. No.: 16/941,736

(22) Filed: Jul. 29, 2020

(65) Prior Publication Data

US 2020/0358190 A1 Nov. 12, 2020

Related U.S. Application Data

(63) Continuation-in-part of application No. 16/013,262, filed on Jun. 20, 2018, now Pat. No. 10,840,607.
(Continued)

(51) Int. Cl.
*H01Q 5/35* (2015.01)
*H01Q 5/28* (2015.01)
(Continued)

(52) U.S. Cl.
CPC ..... *H01Q 5/35* (2015.01); *H01Q 3/36* (2013.01); *H01Q 5/28* (2015.01); *H01Q 9/045* (2013.01)

(58) Field of Classification Search
CPC ..... H01Q 5/35; H01Q 9/04
See application file for complete search history.

(56) References Cited

U.S. PATENT DOCUMENTS 6,943,732 B2 9/2005 Goettl et al.
7,050,005 B2 5/2006 Goettl et al.
(Continued)

FOREIGN PATENT DOCUMENTS

CA 1 226 936 9/1987
CN 101507047 A 8/2009
(Continued)

OTHER PUBLICATIONS

Chinese Office Action corresponding to Chinese Patent Application No. 201810242591 1 (Foreign Text, 8 Pages, English Translation Thereof, 8 Pages) (dated Nov. 4, 2020).
(Continued)

*Primary Examiner* — Andrea Lindgren Baltzell
(74) *Attorney, Agent, or Firm* — Myers Bigel, P.A.

(57) ABSTRACT

Antenna arrays include a first plurality of radiating elements in a first column thereof, which are responsive to a first plurality of RF feed signals derived from a first radio, and a second plurality of radiating elements in a second column thereof, which are responsive to a second plurality of RF feed signals derived from a second radio. A power divider circuit is provided, which is configured to drive a first one of the radiating elements at a first end of the second column of radiating elements with a majority of the energy associated with a first one of the first plurality of RF feed signals, and drive a first one of the radiating elements at a first end of the first column of radiating elements with a non-zero minority of the energy associated with the first one of the first plurality of RF feed signals.

20 Claims, 18 Drawing Sheets

Related U.S. Application Data

(60) Provisional application No. 62/882,052, filed on Aug. 2, 2019, provisional application No. 62/523,386, filed on Jun. 22, 2017.

(51) Int. Cl.
*H01Q 3/36* (2006.01)
*H01Q 9/04* (2006.01)

(56) References Cited

U.S. PATENT DOCUMENTS

| | | | | |
|---|---|---|---|---|
| 8,416,142 | B2 | 4/2013 | Goettl | |
| 9,438,278 | B2 | 9/2016 | Barker et al. | |
| 9,444,151 | B2 | 9/2016 | Kurk et al. | |
| 2004/0051677 | A1 | 3/2004 | Goettl | |
| 2009/0179814 | A1 | 7/2009 | Park et al. | |
| 2009/0278759 | A1 | 11/2009 | Moon et al. | |
| 2011/0148730 | A1 | 6/2011 | Goettl | |
| 2012/0068907 | A1 | 3/2012 | Petersson et al. | |
| 2013/0271336 | A1 | 10/2013 | Plet et al. | |
| 2014/0225792 | A1 | 8/2014 | Lee et al. | |
| 2015/0222015 | A1 | 8/2015 | Thalakotuna et al. | |
| 2015/0222025 | A1* | 8/2015 | Song | H01Q 21/24 343/893 |
| 2015/0263435 | A1 | 9/2015 | Song et al. | |
| 2017/0358857 | A1* | 12/2017 | Watkins | H01Q 1/525 |
| 2019/0273315 | A1 | 9/2019 | Hu et al. | |

FOREIGN PATENT DOCUMENTS

| | | | |
|---|---|---|---|
| CN | 102439786 | A | 5/2012 |
| CN | 103178356 | A | 6/2013 |
| CN | 103716064 | A | 4/2014 |
| CN | 105849976 | A | 8/2016 |
| CN | 106576280 | A | 4/2017 |
| CN | 106711622 | A | 5/2017 |
| CN | 206461086 | | 9/2017 |
| EP | 0163997 | | 5/1987 |
| EP | 0325012 | | 7/1989 |
| EP | 3419104 | A1 | 12/2018 |
| JP | 2004241972 | A | 8/2004 |
| KR | 101720485 | | 3/2017 |
| WO | 99/36992 | | 7/1999 |
| WO | 2010/063007 | | 6/2010 |
| WO | 2015082000 | A1 | 6/2015 |

OTHER PUBLICATIONS

Chinese Office Action corresponding to Chinese Patent Application No. 201810242591.1 (Foreign Text, 10 Pages, English Translation Thereof, 11 Pages) (dated May 26, 2021).

* cited by examiner

CELLULAR COMMUNICATION SYSTEMS HAVING ANTENNA ARRAYS THEREIN WITH ENHANCED HALF POWER BEAM WIDTH (HPBW) CONTROL

REFERENCE TO PRIORITY APPLICATIONS

This application is a continuation-in-part of U.S. application Ser. No. 16/013,262, filed Jun. 20, 2018, now U.S. Pat. No. 10,840,607, which claims priority to U.S. Provisional Application Ser. No. 62/523,386, filed Jun. 22, 2017, the disclosures of which are hereby incorporated herein by reference. This application also claims priority to U.S. Provisional Application Ser. No. 62/882,052, filed Aug. 2, 2019, the disclosure of which is also hereby incorporated herein by reference.

FIELD OF THE INVENTION

The present invention relates to radio communications and antenna devices and, more particularly, to base station antenna arrays for cellular communications and methods of operating same.

BACKGROUND

Phased array antennas can create and electronically steer a beam of radio waves in varying directions without physical movement of the radiating elements therein. As shown by FIG. 1A, in a phased array antenna 10, radio frequency (RF) feed current is provided from a transmitter (TX) to a plurality of spaced-apart antenna radiating elements via phase shifters ($\phi_1$-$\phi_8$), which establish a desired phase relationship between the radio waves emitted by the spaced-apart radiating elements. As will be understood by those skilled in the art, a properly established phase relationship enables the radio waves emitted from the radiating elements to combine to thereby increase radiation in a desired direction (shown as θ), yet suppress radiation in an undesired direction(s). The phase shifters ($\phi_n$) are typically controlled by a computer control system (CONTROL), which can alter the phases of the emitted radio waves and thereby electronically steer the combined waves in varying directions. This electronic steering can be important when the phased array antennas are used in cellular communication and other RF-based systems.

For example, in a typical cellular communications system, a geographic area is often divided into a series of regions that are commonly referred to as "cells", which are served by respective base stations. Each base station may include one or more base station antennas (BSAs) that are configured to provide two-way radio frequency ("RF") communications with mobile subscribers that are within the cell served by the base station. In many cases, each base station is divided into "sectors." In perhaps the most common configuration, a hexagonally shaped cell is divided into three 120° sectors, and each sector is served by one or more base station antennas, which can have an azimuth Half Power Beam Width (HPBW) of approximately 65° per sector. Typically, the base station antennas are mounted on a tower or other raised structure and the radiation patterns (a/k/a "antenna beams") are directed outwardly therefrom. Base station antennas are often implemented as linear or planar phased arrays of radiating elements. For example, as shown by FIG. 1B, a base station antenna 10' may include side-by-side columns of radiating elements ($RE_{11}$-$RE_{18}$, $RE_{21}$-$RE_{28}$), which define a pair of relatively closely spaced antennas A1 and A2. In this base station antenna 10', each column of radiating elements may be responsive to respective phase-shifted feed signals, which are derived from corresponding RF feed signals (FEED1, FEED2) and transmitters (TX1, TX2) and varied in response to computer control (CONTROL1, CONTROL2).

In order to accommodate the ever-increasing volumes of cellular communications, cellular operators have added cellular services in a variety of new frequency bands. While in some cases it is possible to use linear arrays of so-called "wide-band" or "ultra wide-band" radiating elements to provide service in multiple frequency bands, in other cases it is necessary to use different linear arrays (or planar arrays) of radiating elements to support service in the different frequency bands.

As the number of frequency bands has proliferated, increased sectorization has become more common (e.g., dividing a cell into six, nine or even twelve sectors) and the number of base station antennas deployed at a typical base station has increased significantly. However, due to local zoning ordinances and/or weight and wind loading constraints for the antenna towers, etc. there is often a limit as to the number of base station antennas that can be deployed at a given base station. In order to increase capacity without further increasing the number of base station antennas, so-called multi-band base station antennas have been introduced in which multiple linear arrays of radiating elements are included in a single antenna. One very common multi-band base station antenna design is the RVV antenna, which includes one linear array of "low-band" radiating elements that are used to provide service in some or all of the 694-960 MHz frequency band, which is often referred to as the "R-band", and two linear arrays of "high-band" radiating elements that are used to provide service in some or all of the 1695-2690 MHz frequency band, which is often referred to as the "V-band". These linear arrays of R-band and V-band radiating elements are typically mounted in side-by-side fashion.

There is also significant interest in RRVV base station antennas, which can include two linear arrays of low-band radiating elements and two (or four) linear arrays of high-band radiating elements. For example, as shown by FIG. 1C, an RRVV antenna 12 may include two outside columns 14*a*, 14*b* of relatively low-band radiating elements (shown as 5 "large" radiating elements ("X") per column) and two inner columns 16*a*, 16*b* of relatively high-band radiating elements (shown as 9 "small" radiating elements ("x") per column). RRVV antennas may be used in a variety of applications including 4×4 multi-input-multi-output ("MIMO") applications or as multi-band antennas having two different low-bands (e.g., a 700 MHz low-band linear array and an 800 MHz low-band linear array) and two different high-bands (e.g., an 1800 MHz high-band linear array and a 2100 MHz high-band linear array). RRVV antennas, however, are challenging to implement in a commercially acceptable manner because achieving a 65° azimuth HPBW antenna beam in the low-band typically requires low-band radiating elements that are at least 200 mm wide. But, when two arrays of low-band radiating elements are placed side-by-side with high-band linear arrays therebetween, as shown by FIG. 1C, a base station antenna having a width of about 500 mm may be required. Such large RRVV antennas may have very high wind loading, may be very heavy, and/or may be expensive to manufacture. Operators would prefer RRVV base station antennas having widths of about 430 mm, which is a typical width for state-of-the-art base station antennas.

To achieve RRVV antennas having narrower beam widths, the dimensions of the low-band radiating elements may be reduced and/or the lateral spacing between the linear arrays of low-band "R" and high-band "V" radiating elements may be reduced. Unfortunately, as the linear arrays of radiating elements are aligned closer together, the degree of signal coupling between the linear arrays can increase significantly and this "parasitic" coupling can lead to an undesired increase in HPBW. Similarly, any reduction in the dimensions of the low-band radiating elements will often cause an increase in HPBW.

SUMMARY OF THE INVENTION

Antenna arrays according to some embodiments of the invention may include first and second columns of radiating elements responsive to a first plurality of radio frequency (RF) feed signals derived from a first radio and a second plurality of RF feed signals derived from a second radio, respectively. A first power divider circuit is provided, which is configured to drive a first one of the radiating elements in the second column of radiating elements with a majority of the energy associated with a first one of the first plurality of RF feed signals, and to drive a first one of the radiating elements in the first column of radiating elements with a non-zero minority of the energy associated with the first one of the first plurality of RF feed signals. In these embodiments, the first one of the radiating elements in the first column of radiating elements may extend diametrically opposite the first one of the radiating elements in the second column of radiating elements. The first power divider circuit may also be configured to drive the first one of the radiating elements in the first column of radiating elements with a majority of the energy associated with a first one of the second plurality of RF feed signals, and to drive the first one of the radiating elements in the second column of radiating elements with a non-zero minority of the energy associated with the first one of the second plurality of RF feed signals.

In further embodiments of the invention, a second power divider circuit may be provided, which is configured to drive a second one of the radiating elements in the first column of radiating elements with a majority of the energy associated with a second one of the first plurality of RF feed signals, and to drive a second one of the radiating elements in the second column of radiating elements with a non-zero minority of the energy associated with the second one of the first plurality of RF feed signals. This second power divider circuit may be further configured to drive the second one of the radiating elements in the second column of radiating elements with a majority of the energy associated with a second one of the second plurality of RF feed signals, and to drive the second one of the radiating elements in the first column of radiating elements with a non-zero minority of the energy associated with the second one of the second plurality of RF feed signals.

According to still further embodiments of the invention, a first phase shifter is provided, which is configured to generate the first plurality of RF feed signals in response to a first RF input feed signal generated by the first radio. A second phase shifter may also be provided, which is configured to generate the second plurality of RF feed signals in response to a second RF input feed signal generated by the second radio. Accordingly, the first plurality of RF feed signals may be phase shifted relative to each other, and the second plurality of RF feed signals may be phase shifted relative to each other.

According to additional embodiments of the invention, a second one of the radiating elements in the first column of radiating elements receives all of the energy associated with a second one of the first plurality of RF feed signals, and a second one of the radiating elements in the second column of radiating elements receives all of the energy associated with a second one of the second plurality of RF feed signals. Accordingly, the second one of the radiating elements in the first column of radiating elements may receive none of the energy associated with the second plurality of RF feed signals, and the second one of the radiating elements in the second column of radiating elements may receive none of the energy associated with the first plurality of RF feed signals.

In still further embodiments of the invention, an antenna array is provided with first and second arrays of radiating elements therein, which are responsive to a first plurality of radio frequency (RF) feed signals derived from a first RF transmitter and a second plurality of RF feed signals derived from a second RF transmitter, respectively. A first power divider circuit is provided, which is configured to drive: (i) a first one of the radiating elements in the second array of radiating elements with a majority of the energy associated with a first one of the first plurality of RF feed signals, (ii) a first one of the radiating elements in the first array of radiating elements with a non-zero minority of the energy associated with the first one of the first plurality of RF feed signals, (iii) the first one of the radiating elements in the first array of radiating elements with a majority of the energy associated with a first one of the second plurality of RF feed signals, and (iv) the first one of the radiating elements in the second array of radiating elements with a non-zero minority of the energy associated with the first one of the second plurality of RF feed signals. The antenna array may also be configured so that a second one of the radiating elements in the first array of radiating elements receives all of the energy associated with a second one of the first plurality of RF feed signals, and a second one of the radiating elements in the second array of radiating elements receives all of the energy associated with a second one of the second plurality of RF feed signals.

Alternatively, a second power divider circuit may be provided, which is configured to drive a second one of the radiating elements in the first array of radiating elements with a majority of the energy associated with a second one of the first plurality of RF feed signals, and drive a second one of the radiating elements in the second array of radiating elements with a non-zero minority of the energy associated with the second one of the first plurality of RF feed signals.

According to additional embodiments of the invention, an antenna array is provided with a first plurality of radiating elements in a first column, which are responsive to a first plurality of RF feed signals derived from a first radio, and a second plurality of radiating elements in a second column, which are responsive to a second plurality of RF feed signals derived from a second radio. A power divider circuit is provided, which is configured to drive a first one of the radiating elements at a first end of the second column of radiating elements with a majority of the energy associated with a first one of the first plurality of RF feed signals, and to drive a first one of the radiating elements at a first end of the first column of radiating elements with a non-zero minority of the energy associated with the first one of the first plurality of RF feed signals. This first power divider circuit may also be configured to drive the first one of the radiating elements in the first column of radiating elements with a majority of the energy associated with a first one of the second plurality of RF feed signals, and to drive the first one of the radiating elements in the second column of radiating elements with a non-zero minority of the energy associated with the first one of the second plurality of RF feed signals. In addition, a second one of the radiating elements in the first column of radiating elements may be driven with all of the energy associated with a second one of the first plurality of RF feed signals and none of the energy associated with a second of the second plurality of RF feed signals. Similarly, a second one of the radiating elements in the second column of radiating elements may be driven with all of the energy associated with a second one of the second plurality of RF feed signals and none of the energy associated with a second of the first plurality of RF feed signals. In some of these embodiments of the invention, the second one of the radiating elements in the first column of radiating elements may be located at a second end of the first column of radiating elements, and the second one of the radiating elements in the second column of radiating elements may be located at a second end of the second column of radiating elements. In some of these embodiments of the invention, the first and second columns of radiating elements are aligned so that each of the radiating elements in the first column of radiating elements extends diametrically opposite a corresponding one of the radiating elements in the second column of radiating elements.

DETAILED DESCRIPTION OF EMBODIMENTS

Figure 1A:
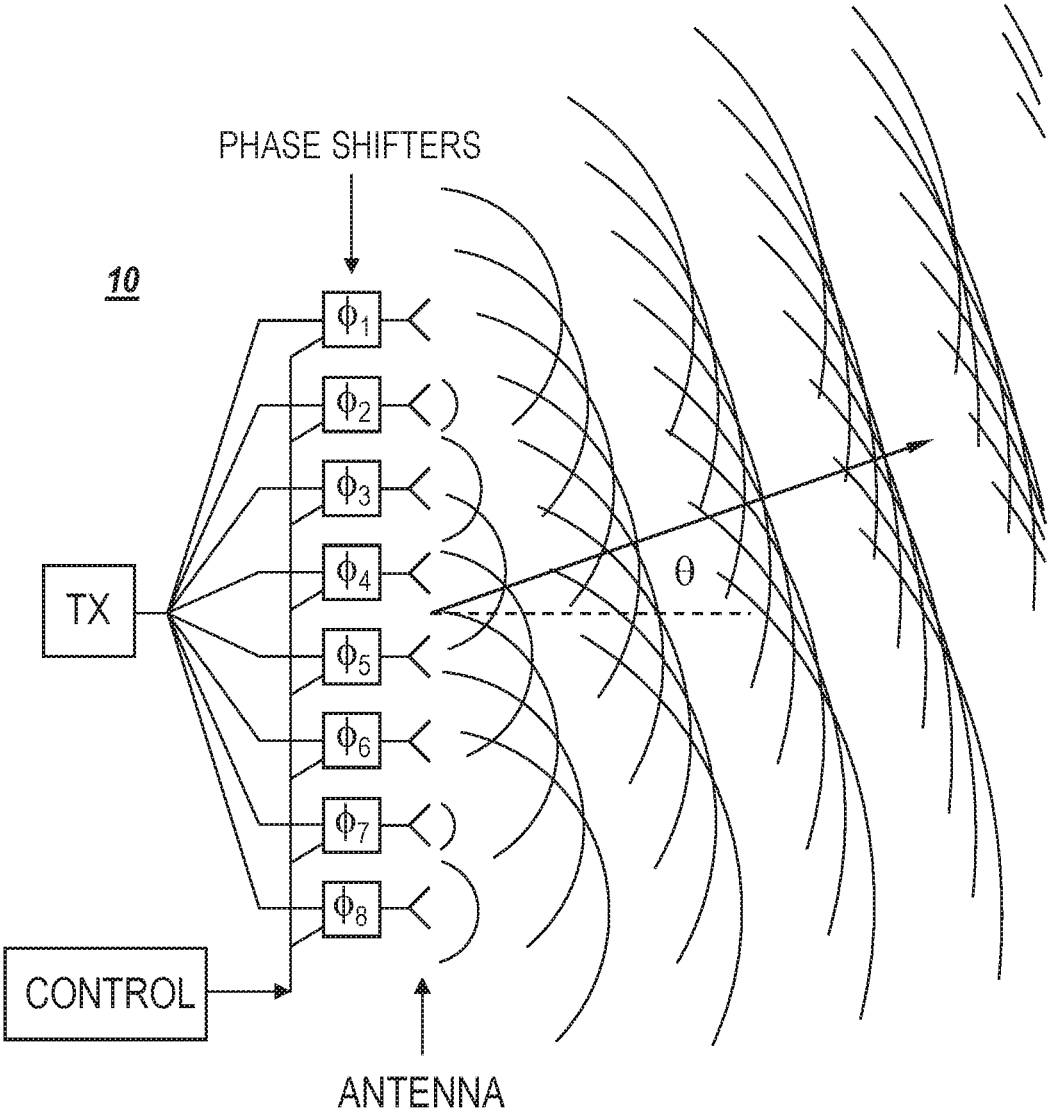
Fig. 1A (Prior Art)
FIG. 1A is a block diagram of a phased array antenna according to the prior art.
Figure 1B:
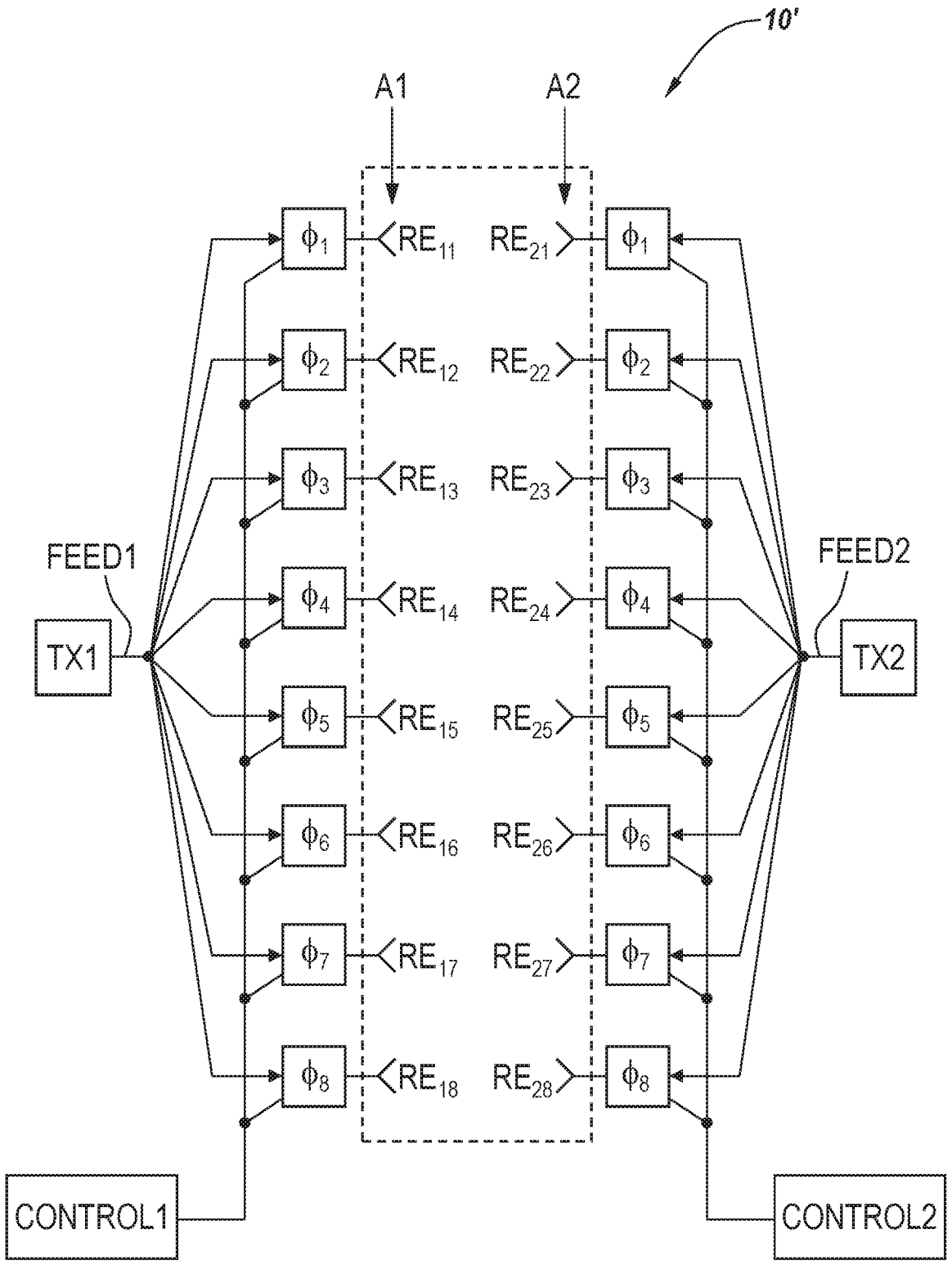
Fig. 1B (Prior Art)
FIG. 1B is a block diagram of a base station antenna (BSA) according to the prior art.
Figure 1C:
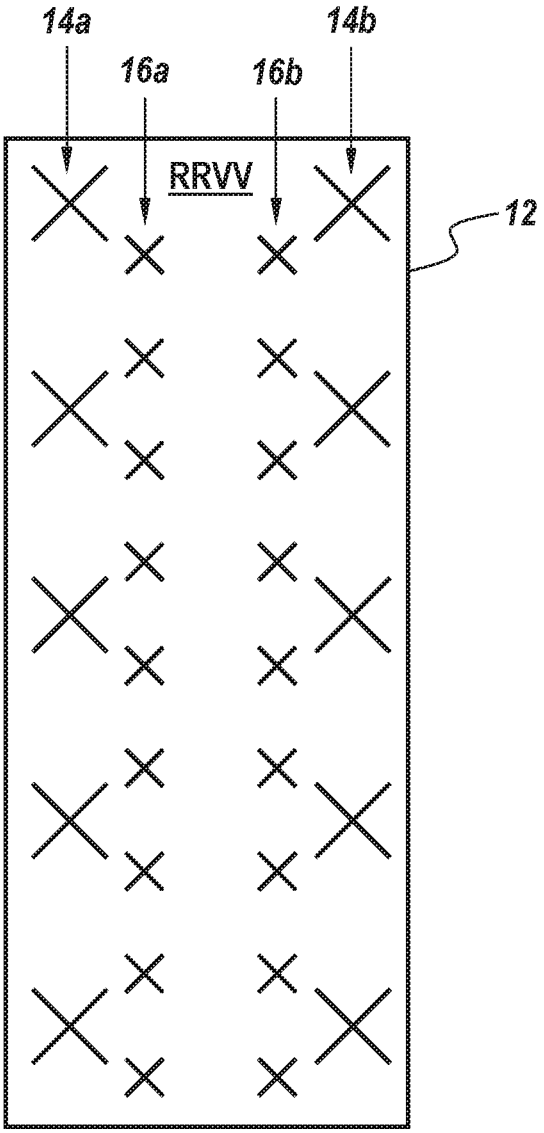
Fig. 1C (Prior Art)
FIG. 1C is a plan layout view of an RRVV base station antenna, which shows the arrangement of two linear arrays of low-band radiating elements (X) and two linear arrays of high-band radiating elements (x), according to the prior art.

The present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
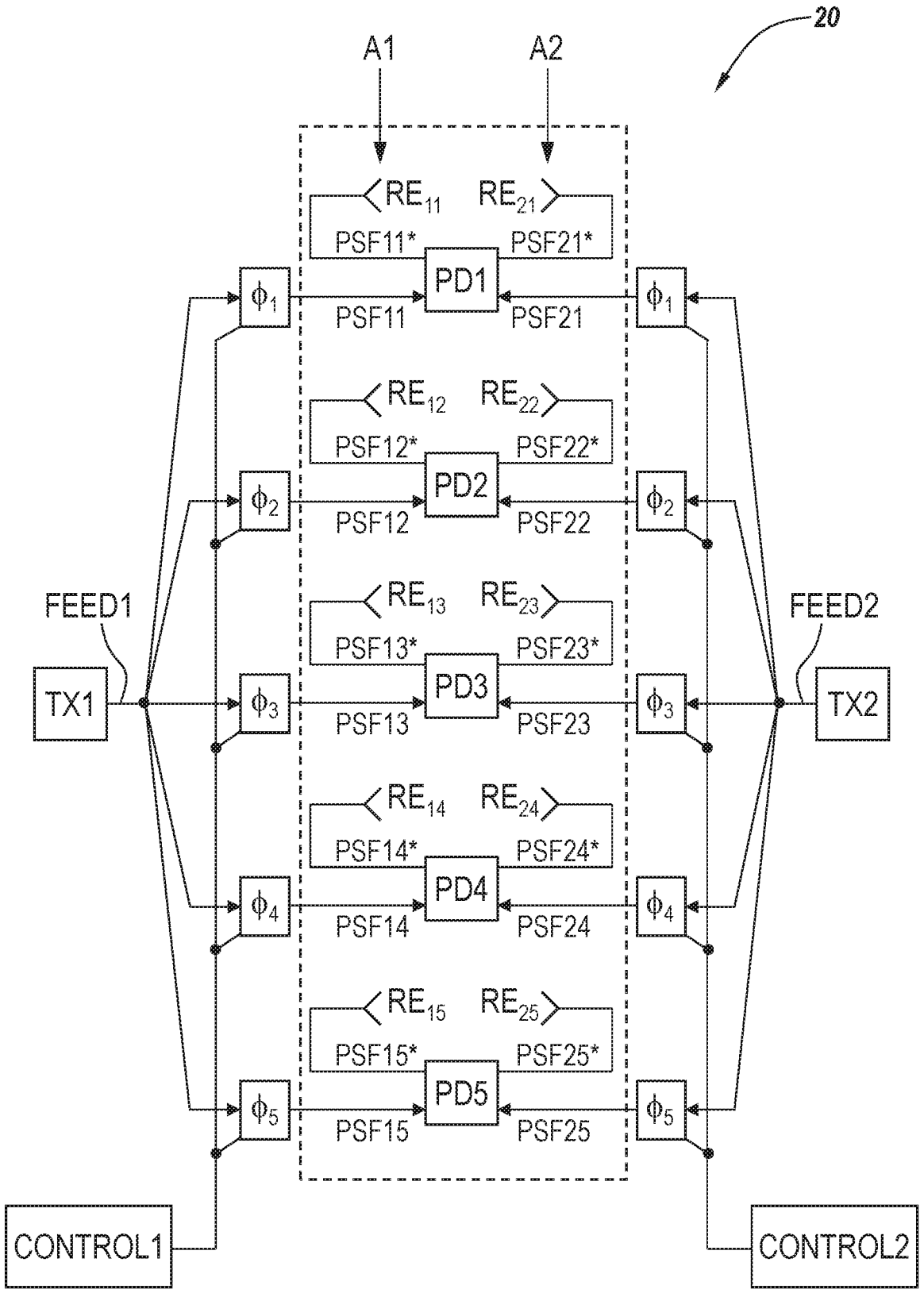
FIG. 2 is a block diagram of a base station antenna (BSA) having a plurality of HPBW-enhancing power divider circuits therein, according to an embodiment of the present invention.

Referring now to FIG. 2, a base station antenna (BSA) 20 according to an embodiment of the invention is illustrated as including two linear arrays (i.e., columns) of five (5) radiating elements ($RE_{11}$-$RE_{15}$, $RE_{21}$-$RE_{25}$) per array, which define left and right low-band antennas (A1, A2). As shown, each left and right pair of radiating elements (($RE_{11}$-$RE_{21}$), ($RE_{12}$-$RE_{22}$), . . . , ($RE_{15}$-$RE_{25}$)) is responsive to a corresponding pair of modified phase-shift feed signals ((PSF11, PSF21*), (PSF12, PSF22*), . . . , (PSF15, PSF25*)), which are generated by corresponding power divider circuits (PDn=PD1, PD2, . . . , or PD5). Each of the power divider circuits PDn is responsive to a pair of phase shift feed (PSF) signals generated by corresponding left-side phase shifters ($\phi_1$-$\phi_5$) and right-side phase shifters ($\phi_1$-$\phi_5$). The left-side phase shifters ($\phi_1$-$\phi_5$) are collectively responsive to a first RF feed signal (FEED1) generated by a first transmitter TX1 and phase controls signals generated by a first controller (CONTROL1). The right phase shifters ($\phi_1$-$\phi_5$) are collectively responsive to a second RF feed signal (FEED1) generated by a second transmitter TX2 and phase control signals generated by a second controller (CONTROL2).

The left and right low-band antennas A1 and A2 may or may not transmit in the same frequency band. For example, in some cases, the two antennas A1 and A2 may be operated to support multi-input-multi-output ("MIMO") transmissions where the same signal is transmitted through multiple linear arrays of radiating elements after being "pre-distorted" (based on known characteristics of a specified channel) so that the multiple transmitted signals (in the same frequency band) constructively combine at a receiver location. This "MIMO" technique can be very effective in reducing the effects of fading, signal reflections and the like.

In other cases, the two antennas A1 and A2 may point in different directions to provide independent antenna beams in the same or different frequency bands. Thus, one low band antenna (e.g., A1) may transmit in a first frequency band (e.g., the 700 MHz band) and the other low band antenna (A2) may transmit in a different frequency band (e.g., the 800 MHz band), which means the transmitted signals from A1 and A2 will not overlap in frequency.

As will be understood by those skilled in the art, the left side (and right side) phase shifters ($\phi_1$-$\phi_5$) may operate within a larger phase shifter circuit that typically performs multiple functions. First, this phase shifter circuit may perform a 1×5 power split so that a corresponding RF feed signal (e.g., FEED1, FEED2) can be sub-divided into five lower power feed signals that are directly fed to corresponding power divider circuits PDn. Second, the phase shifter circuit may generate a phase taper across the individual feed signals (e.g., −2°, −1°, 0°, +1°, +2° phase variations), thereby yielding the lower power feed signals as phase-shifted feed signals (PSF). Advantageously, this phase taper, which can create a desired electronic "downtilt" on the elevation pattern of the resulting antenna beam, can be remotely controlled and adjusted.

Moreover, as highlighted below with respect to cross-coupled power divider circuit 30*e* of FIG. 3E, according to some alternative embodiments of the invention, a single power divider circuit may be placed between each feed signal transmitter (TX1, TX2) and corresponding phase shifter ($\phi_1$-$\phi_5$) to thereby yield improvements in half power beam widths (HPBW). Nonetheless, when the two antennas A1 and A2 are operated to support multi-input-multi-output ("MIMO") transmissions, the same downtilt will be applied to both antennas. In addition, when one antenna covers one frequency band (e.g., 700 MHz band) and the other antenna covers another frequency band (e.g., 800 MHz band), the downtilt will be different on the two bands. In both of these applications, the embodiment of FIG. 3E may be less preferred relative to the embodiment of FIG. 2 and the embodiments of FIGS. 4B-4C, described hereinbelow. Moreover, the embodiment of FIG. 3E may result in relatively higher signal losses by virtue of the fact that higher amounts of signal energy may be lost to ground (GND) within the power divider circuit 30*e*. Nonetheless, as shown by FIG. 5, which is a graph comparing a−180° to +180° beam width profile of an RRVV antenna (with one column activated) versus a beam width profile of a corresponding RRVV antenna that utilizes the power divider circuit of FIG. 3E, HPBW improvements can be achieved with a single power divider circuit 30*e* for the RR arrays of an RRVV antenna.

Figure 3A:
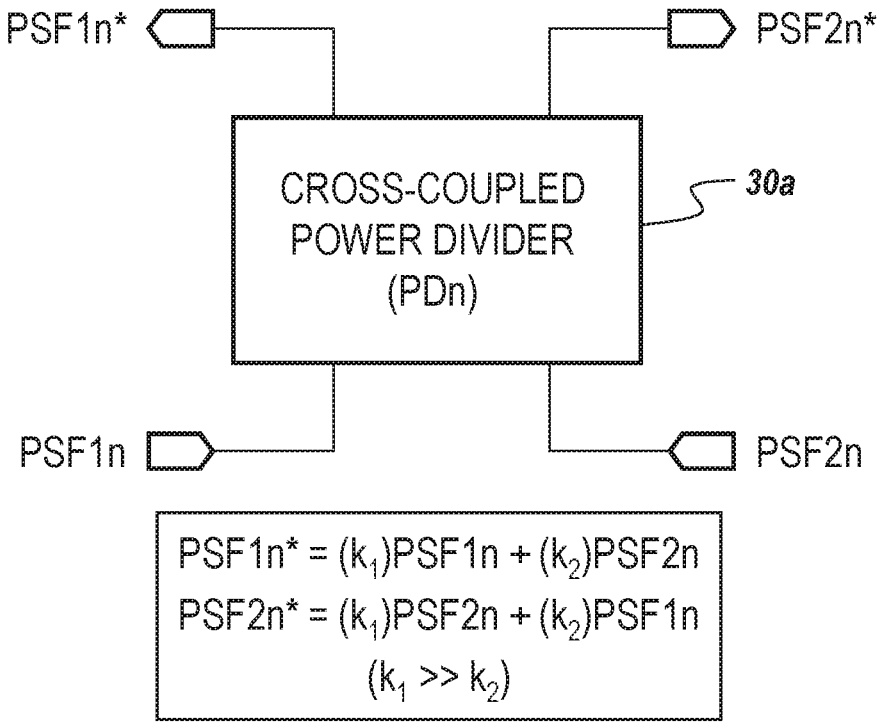
FIG. 3A is a block diagram of a HPBW-reducing power divider circuit, according to an embodiment of the present invention.

Referring now to FIG. 3A, a power divider circuit 30*a*, which may be utilized to perform the operations of the power divider circuits PD1-PD5 of FIG. 2, is illustrated as generating a pair of modified phase-shifted feed signals PSF1*n and PSF2*n by intentionally cross-coupling a pair of phase-shifted input feed signals PSF1*n* and PSF2*n*, which can be generated by respective phase-shifters ($\phi_n$) associated with the spaced-apart antennas A1 and A2 in the BSA 20, as shown by FIG. 2. In particular, the modified phase-shifted feed signal PSF1*n** is generated as a first combination of a first phase-shifted input feed signal PSF1*n* and a second phase-shifted input feed signal PSF2*n*. According to some embodiments of the invention, the modified phase-shifted feed signal PSF1*n** is generated according to the following relationship: PSF1*n**=($k_1$) PSF1*n*+($k_2$) PSF2*n*, where PSF1*n* denotes a first RF feed signal, PSF2*n* denotes a second RF feed signal, $k_1$ is a first power conversion coefficient and $k_2$ is a second power conversion coefficient, and where: $0.7 \leq k_1 \leq 0.9$ and $0.0026 \leq k_2 \leq 0.027$. Similarly, the modified phase-shifted input feed signal PSF2*n** is generated as: PSF2*n**=($k_1$) PSF2*n*+($k_2$) PSF1*n*, where $k_1$ is the first power conversion coefficient and $k_2$ is the second power conversion coefficient. In alternative embodiments of the invention, these first and second power conversion coefficients $k_1$ and $k_2$ associated with the generation of the modified phase-shifted input feed signal PSF2*n** may be provided as a third power conversion coefficient $k_1$*, where $k_1^* \neq k_1$ and a fourth power conversion coefficient $k_2$*, where $k_2^* \neq k_2$, and where: $0.7 \leq k_1^* \leq 0.9$ and $0.0026 \leq k_2^* 0.027$. Finally, whereas the cross-coupling operations illustrated by FIG. 3A are performed on already phase-shifted feed signals (PSFs), these operations may be performed "globally" on each of the transmitter-generated feed signals FEED1, FEED2, as shown by FIG. 3E.

Figure 3B:
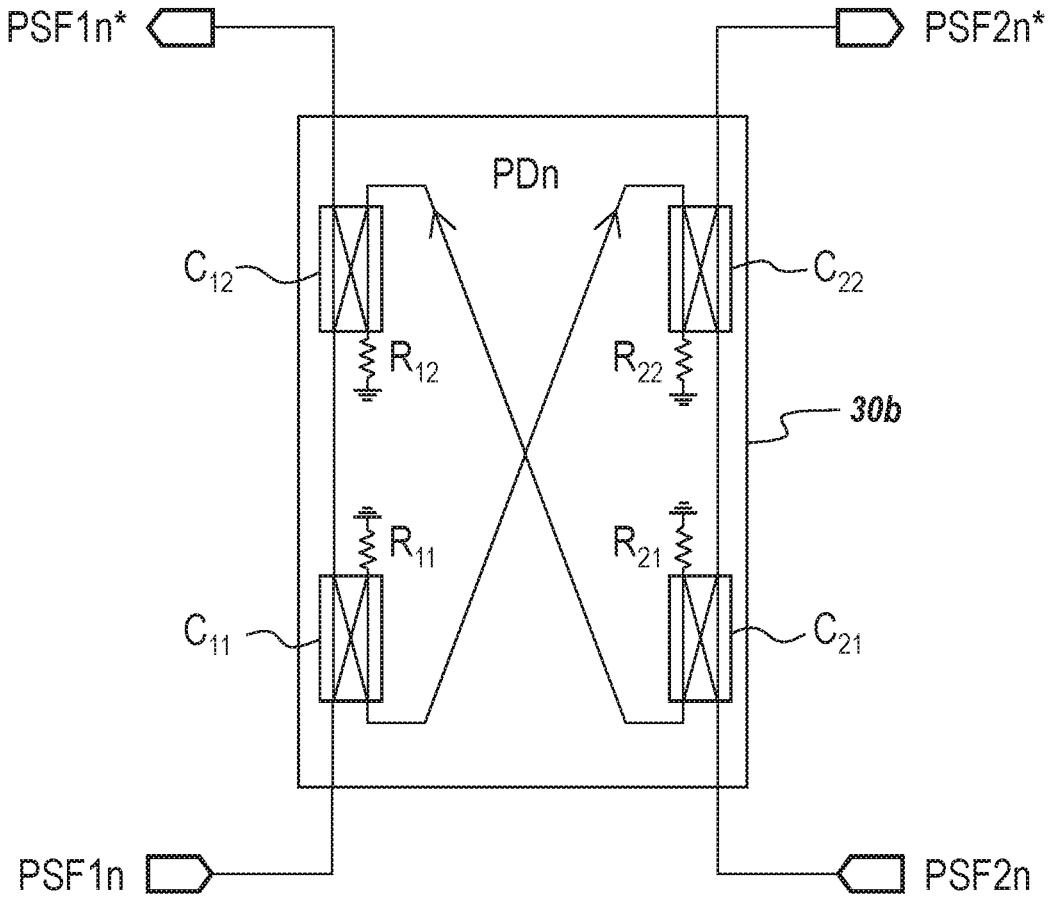
FIG. 3B is an electrical schematic of an HPBW-reducing power divider circuit, according to an embodiment of the present invention.
Figure 3C:
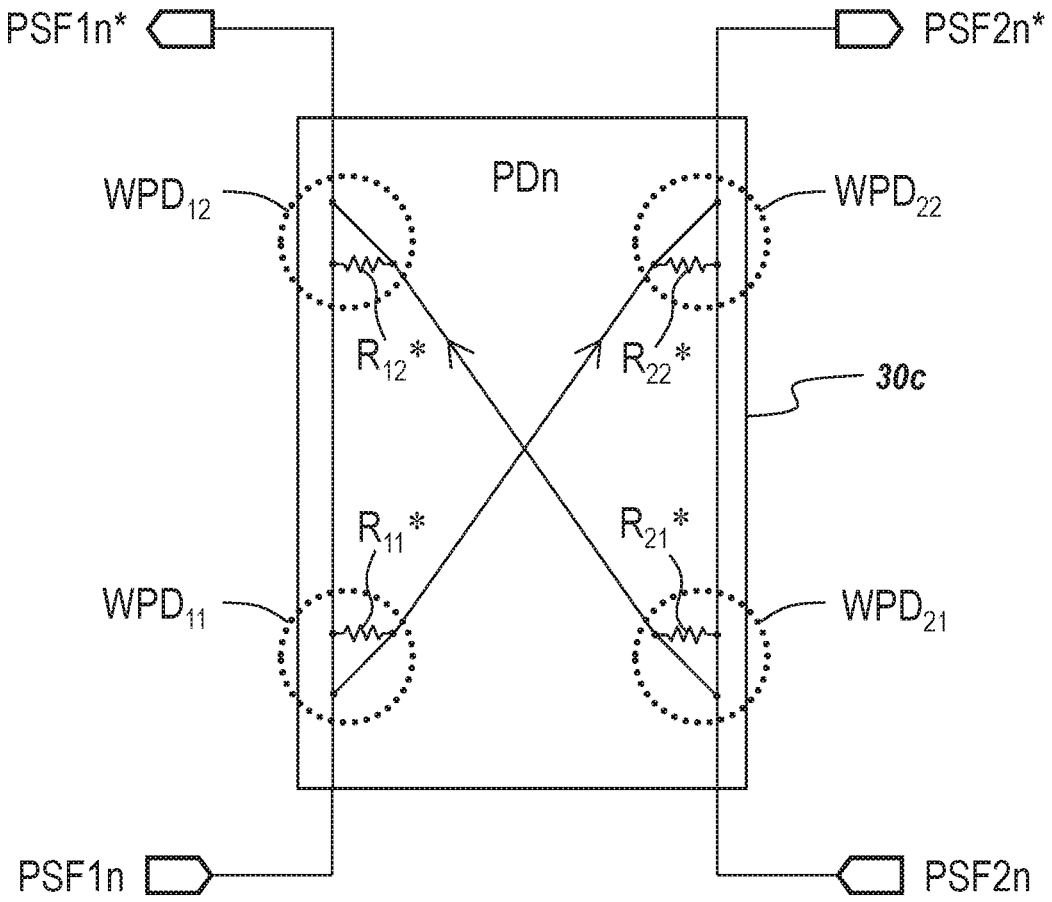
FIG. 3C is an electrical schematic of an HPBW-reducing power divider circuit, according to an embodiment of the present invention.
Figure 3D:
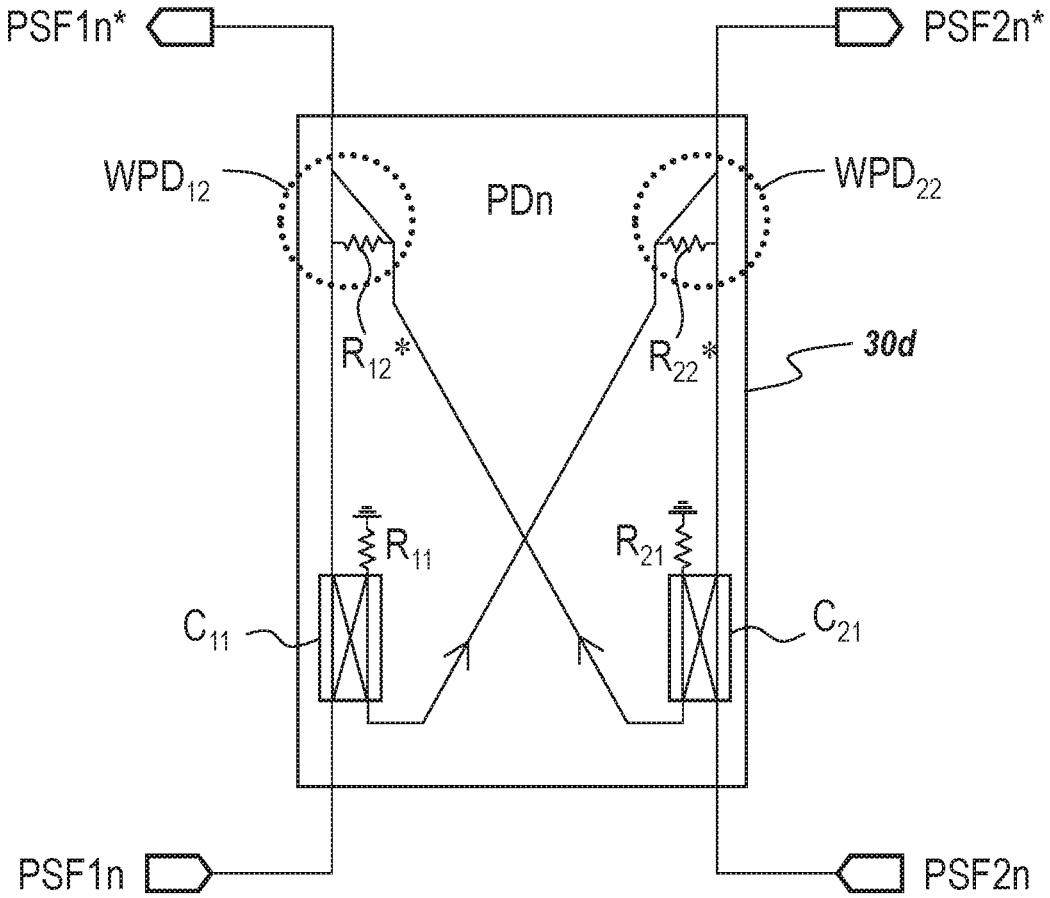
FIG. 3D is an electrical schematic of an HPBW-reducing power divider circuit, according to an embodiment of the present invention.
Figure 3E:
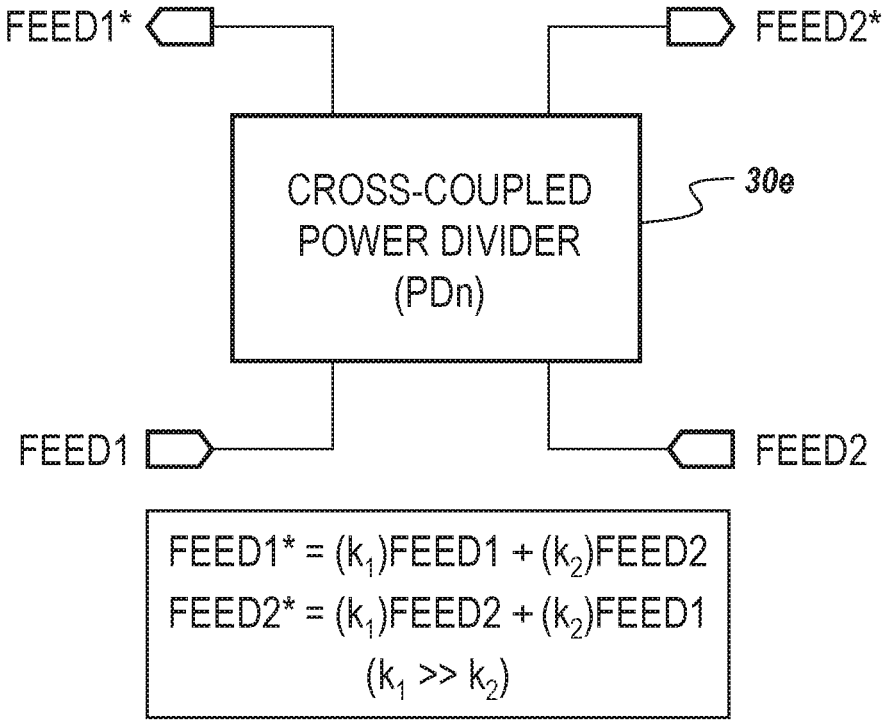
FIG. 3E is an electrical schematic of an HPBW-reducing power divider circuit, according to an embodiment of the present invention.

As illustrated by the embodiments of FIGS. 3B-3D, multiple alternative circuit designs may be utilized to perform the operations illustrated by the power divider circuit 30*a* of FIG. 3A. For example, as shown by the power divider circuit 30*b* of FIG. 3B, two pairs of 4-port cascaded directional couplers (($C_{11}$-$C_{12}$), ($C_{21}$-$C_{22}$)) may be cross-coupled, with single-port resistor termination via $R_{11}$, $R_{12}$, $R_{21}$, $R_{22}$, to thereby convert phase-shifted input feed signals PSF1*n*, PSF2*n* to modified phase-shifted input feed signals PSF1*n**, PSF2*n**.

According to some embodiments of the invention, the directional couplers $C_{11}$, $C_{12}$, $C_{21}$ and $C_{22}$ of FIG. 3B may be configured as four-port directional couplers (e.g., −10 dB coupler) having equivalent characteristics, where $R_{11}$, $R_{12}$, $R_{21}$, $R_{22}$ can be 50 ohms. If, as illustrated by FIG. 3B and the power divider circuit 30*f* of FIG. 3F, the directional couplers $C_{11}$, $C_{12}$, $C_{21}$ and $C_{22}$ are equivalent−10 dB couplers, then coupler $C_{11}$ will pass 90% of the energy associated with the first phase-shifted input feed signal PSFn1 to an input of coupler $C_{12}$ and couple 10% of the energy associated with the first phase-shifted input feed signal PSFn1 to coupler $C_{22}$, where 90% of the coupled 10% signal will pass through termination resistor $R_{22}$ to ground (and lost) and 10% of the coupled 10% signal (i.e., 1%=0.01, or −20 dB) will be provided to the output of $C_{22}$ (as a signal component of PSF2*n). Likewise, coupler $C_{21}$ will pass 90% of the energy associated with the second phase-shifted input feed signal PSFn2 to an input of coupler $C_{22}$ and couple 10% of the energy associated with the second phase-shifted input feed signal PSFn2** to coupler $C_{12}$ where 90% of the coupled 10% signal will pass through termination resistor $R_{12}$ to ground (and lost) and 10% of the coupled 10% signal (i.e., 1%) will be provided to the output of $C_{12}$ (as a component of PSF1*n**). In a similar manner, 90% of the 90% PSF1*n* signal received at an input of coupler $C_{12}$ will be passed as "(0.81)PSF1*n*", the primary energy component of PSF1*n**, and 90% of the 90% PSF2*n* signal received at an input of coupler $C_{22}$ will be passed as "(0.81)PSF2*n*", the primary energy component of PSF2*n**.

FIG. 3C illustrates an alternative power divider circuit 30*c*, which substitutes four Wilkinson power dividers $WPD_{11}$, $WPD_{12}$, $WPD_{21}$ and $WPF_{22}$, containing resistors $R^*_{11}$, $R^*_{12}$, $R^*_{21}$ and $R^*_{22}$ for the directional couplers $C_{11}$, $C_{12}$, $C_{21}$ and $C_{22}$ illustrated in FIG. 3B. The values of these resistors $R^*_{11}$, $R^*_{12}$, $R^*_{21}$ and $R^*_{22}$ may be unequal in some embodiments of the invention in order to achieve asymmetric coupling where $k_1$ and $k_1$* are unequal, and $k_2$ and $k_2$* are unequal. And, in the embodiment of FIG. 3D, a power divider circuit 30*d* is illustrated as including a pair of directional couplers $C_{11}$, $C_{21}$ (of FIG. 3B) in combination with a pair of Wilkinson power dividers $WPD_{12}$ and $WPF_{22}$ (of FIG. 3C). Each of these embodiments advantageously supports the cross-coupling of feed signal energy highlighted above with respect to FIG. 3A.

Figure 3F:
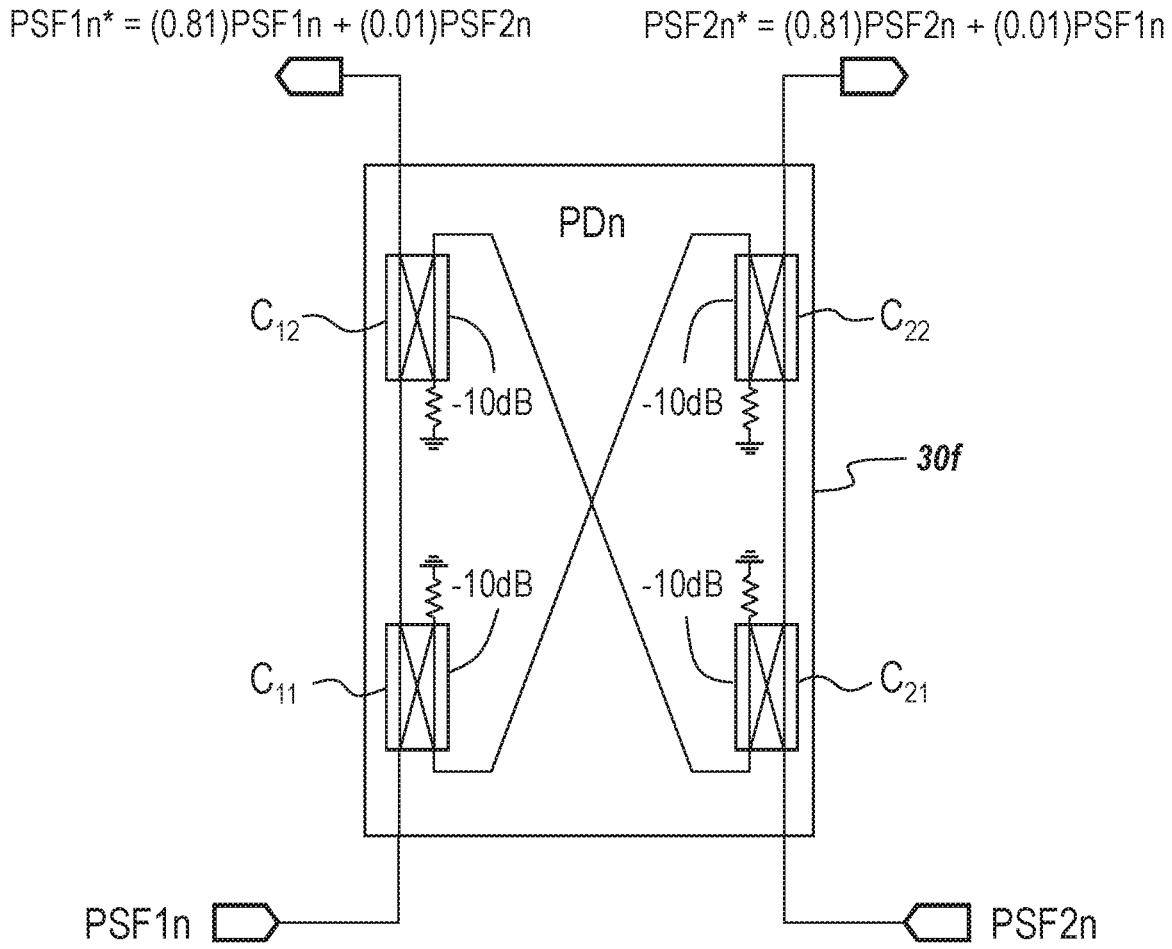
FIG. 3F is an electrical schematic of an HPBW-reducing power divider circuit containing four−10 dB four-port directional couplers, according to an embodiment of the present invention.
Figure 4A:
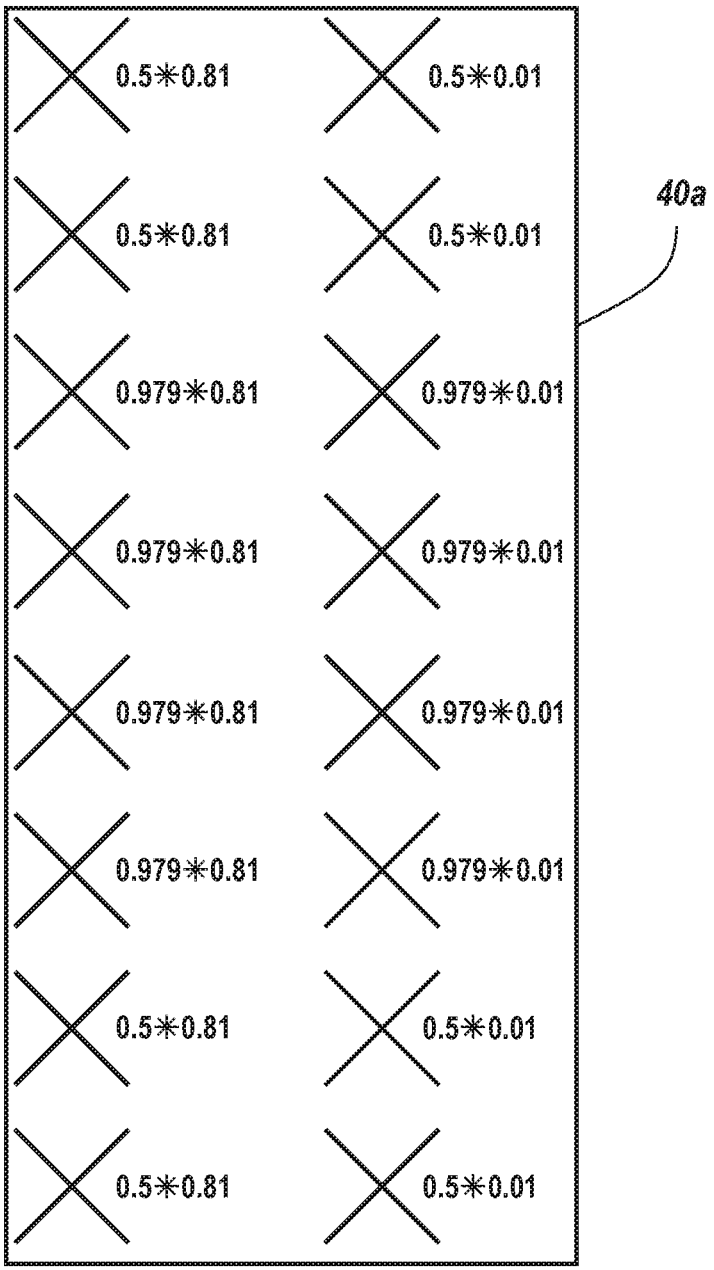
FIG. 4A is a plan view of left and right columns of low-band radiating elements within a base station antenna, which illustrates how phase-shifted feed (PSF) signals associated with the left column of low-band radiating elements are provided, at reduced power levels, to the left and right columns of low-band radiating elements, according to embodiments of the present invention.
Figure 4B:
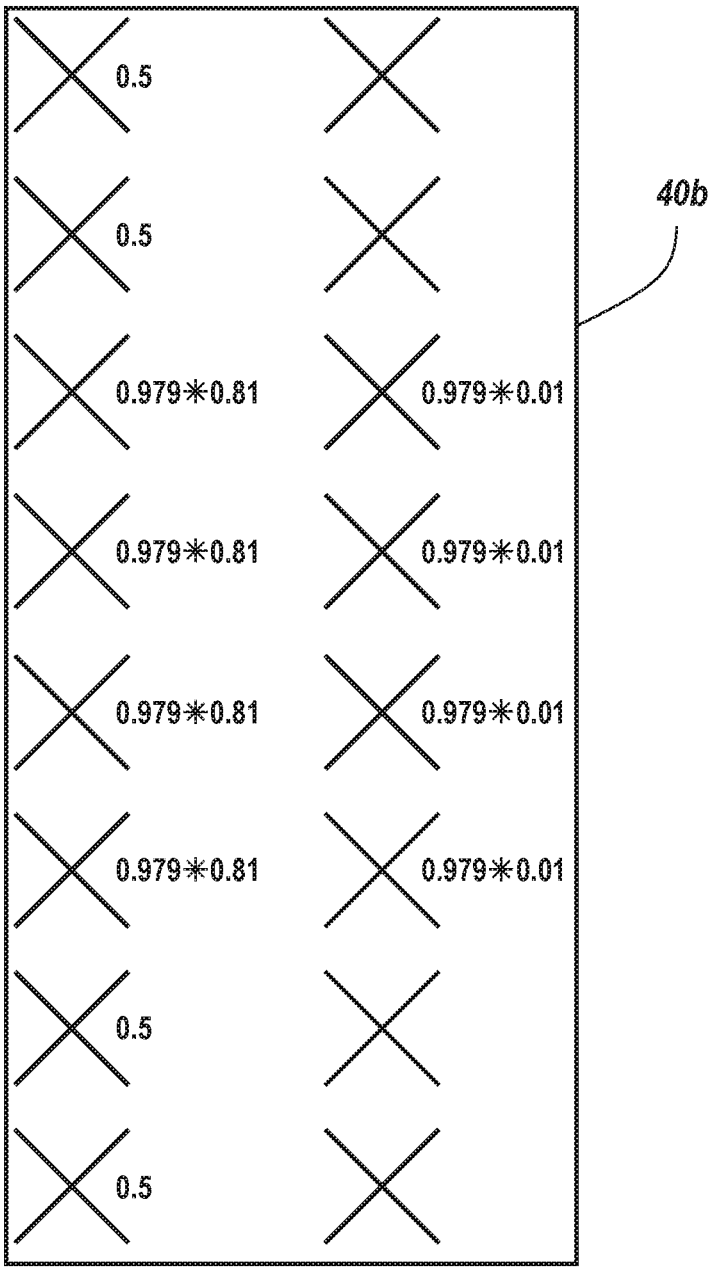
FIG. 4B is a plan view of left and right columns of low-band radiating elements within a base station antenna, which illustrates how phase-shifted feed (PSF) signals associated with the left column of low-band radiating elements are provided, at reduced power levels, to half of the radiating elements in the left and right columns of low-band radiating elements, according to embodiments of the present invention.
Figure 4C:
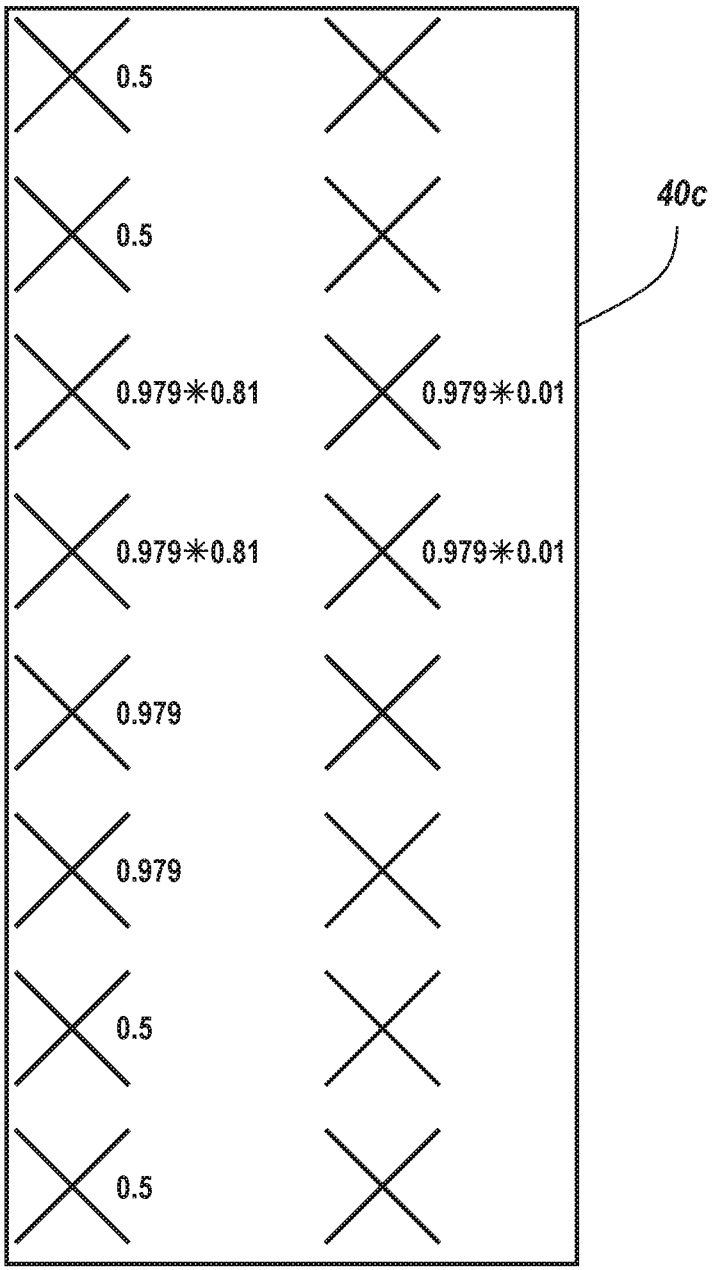
FIG. 4C is a plan view of two columns of low-band radiating elements within a base station antenna, which illustrates how phase-shifted feed (PSF) signals associated with the left column of low-band radiating elements are provided, at reduced power levels, to one quarter of the radiating elements in the left and right columns of low-band radiating elements, according to embodiments of the present invention.
Figure 5:
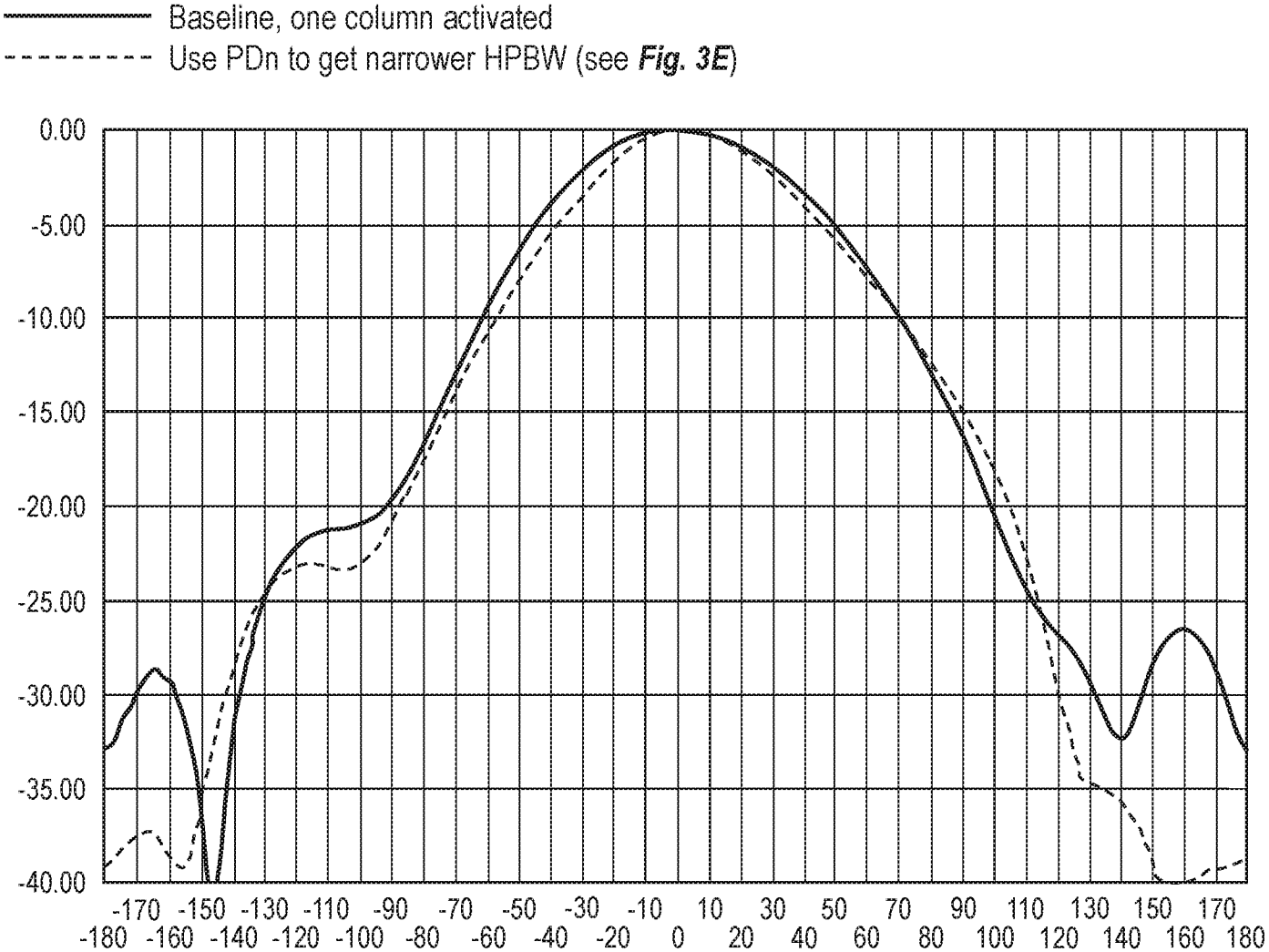
FIG. 5 is a graph comparing an azimuth beam width profile of an RRVV antenna (with one column activated), as shown by a solid line, versus an azimuth beam width profile of a corresponding RRVV antenna that utilizes the power divider circuit of FIG. 3E, where $k_1$=0.81 and $k_2$=0.01.

As shown by FIGS. 3F and 4A-4C, left and right columns of low-band radiating elements may utilize varying numbers of cross-coupled power divider circuits 30*f* within base station antennas 40*a*, 40*b* and 40*c*, to achieve varying levels of half-power beam width HPBW reduction. In FIG. 4A, all eight phase-shifted feed signals PSF1*n* associated with a left-side array of radiating elements may be generated at 0.979 or 0.5 power levels before undergoing cross-coupling to further reduced power levels of 0.979(0.81) and 0.5(0.81) for the left-side array and 0.979(0.01) and 0.5(0.01), at 1% coupling, for all radiating elements in the right-side array. This 1% coupling is a form of "intentional" signal interference to achieve appreciable HPBW reduction with minimal adverse consequences to the integrity of the primary feed signal(s) associated with the right-side array of radiating elements. In contrast, in FIG. 4B, only the center four radiating elements in the left-side and right-side arrays receive coupled signals, whereas in FIG. 4C, only a single pair of radiating elements receive coupled signals. Nonetheless, each of these "intentional" cross-coupling embodiments can be utilized advantageously to reduce HPBW to varying degrees at varying levels of power efficiency.

Figure 6A:
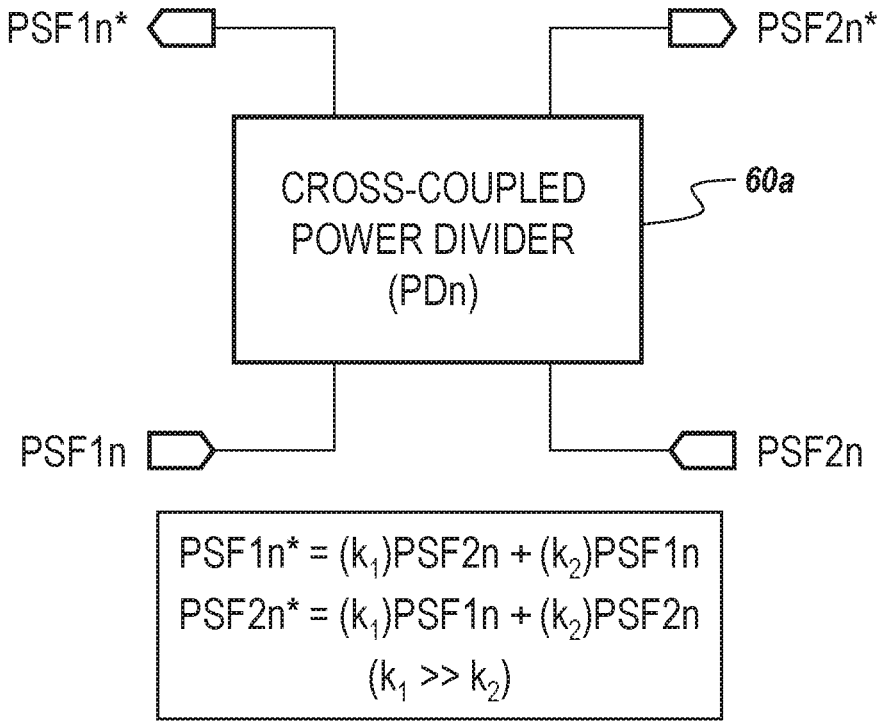
FIG. 6A is a block diagram of a HPBW-reducing power divider circuit, according to an embodiment of the present invention.

Referring now to FIG. 6A, an alternative power divider circuit 60*a* is illustrated as generating a pair of modified phase-shifted feed signals PSF1*n** and PSF2*n** by intentionally cross-coupling a pair of phase-shifted input feed signals PSF1*n* and PSF2*n*, which can be generated by respective phase-shifters ($\phi_n$) associated with the spaced-apart antennas A1 and A2 in the BSA 20, as shown by FIG. 2. In particular, the modified phase-shifted feed signal PSF1*n of FIG. 6**A is generated as a first combination of a first phase-shifted input feed signal PSF1*n* and a second phase-shifted input feed signal PSF2*n*. According to some embodiments of the invention, the modified phase-shifted feed signal PSF1*n** is generated according to the following relationship: PSF1*n**=($k_1$) PSF2*n*+($k_2$) PSF1*n*, where PSF1*n* denotes a first RF feed signal, PSF2*n* denotes a second RF feed signal, $k_1$ is a first power conversion coefficient and $k_2$ is a second power conversion coefficient, and where: $0.7 \leq k_1 \leq 0.9$ and $0.0026 \leq k_2 \leq 0.027$. Similarly, the modified phase-shifted input feed signal PSF2*n** is generated as: PSF2*n**=($k_1$) PSF1*n*+($k_2$) PSF2*n*, where $k_1$ is the first power conversion coefficient and $k_2$ is the second power conversion coefficient. In still further embodiments of the invention, the first power conversion coefficient $k_1$ may be specified as: $0.7 \leq k_1$, and the second power conversion coefficient $k_2$ may be specified as: $k_2 \leq 0.05$.

Figure 6B:
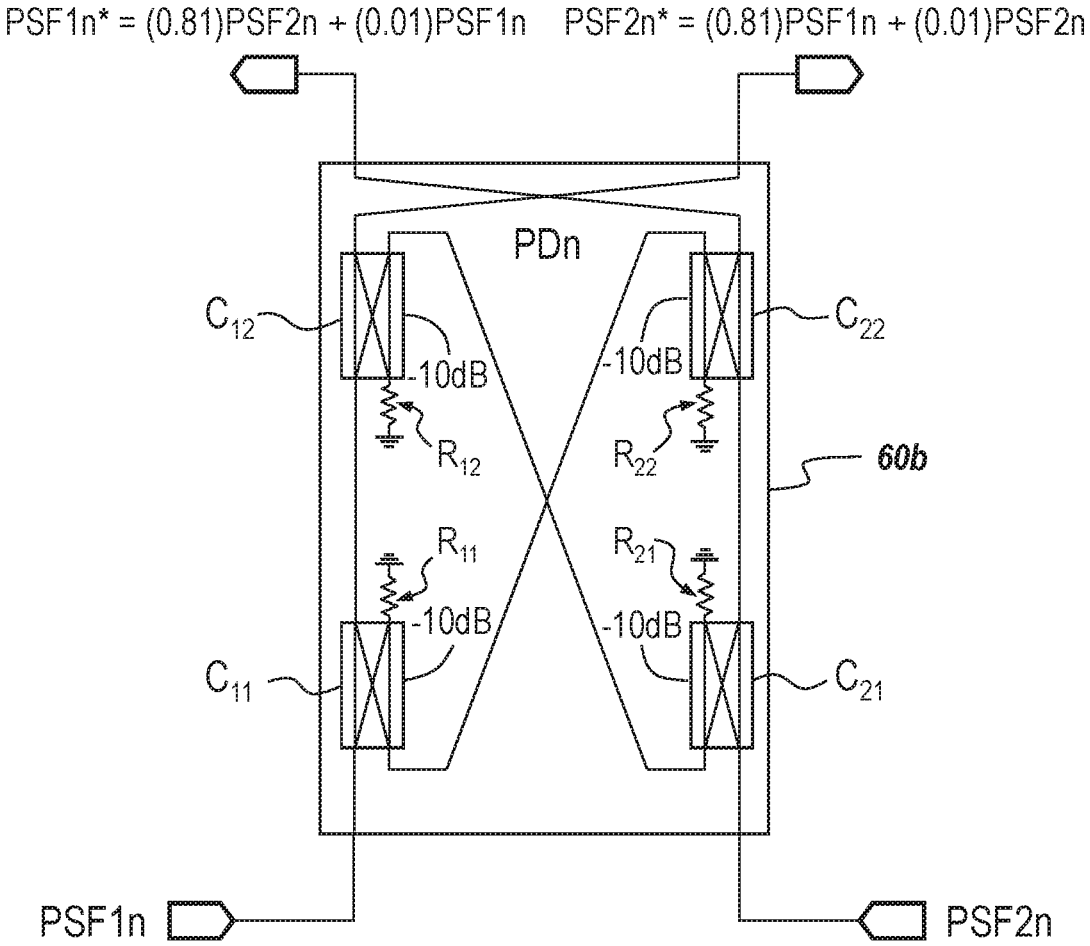
FIG. 6B is an electrical schematic of an HPBW-reducing power divider circuit, according to an embodiment of the present invention.

An embodiment of the power divider circuit 60*a* of FIG. 6A may be configured to include two pairs of cascaded directional couplers (($C_{11}$-$C_{12}$), ($C_{21}$-$C_{22}$)), which are cross-coupled to each other and include single-port resistor termination via $R_{11}$, $R_{12}$, $R_{21}$, $R_{22}$, as shown by the power divider circuit 60*b* of FIG. 6B. The directional couplers $C_{11}$, $C_{12}$, $C_{21}$ and $C_{22}$ of FIG. 6B may be configured as four-port directional couplers (e.g., −10 dB coupler) having equivalent characteristics, where $R_{11}$, $R_{12}$, $R_{21}$, $R_{22}$ can be 50 ohms. If, as illustrated by FIG. 6B, the directional couplers $C_{11}$, $C_{12}$, $C_{21}$ and $C_{22}$ are equivalent−10 dB couplers, then coupler $C_{11}$ will pass 90% of the energy associated with the first phase-shifted input feed signal PSFn1 to an input of coupler $C_{12}$ and couple 10% of the energy associated with the first phase-shifted input feed signal PSFn1 to coupler $C_{22}$, where 90% of the coupled 10% signal will pass through termination resistor $R_{22}$ to ground (and lost) and 10% of the coupled 10% signal (i.e., 1%=0.01, or −20 dB) will be provided to the output of $C_{22}$ (as a minor signal component of PSF1*n****). Likewise, coupler $C_{21}$ will pass 90% of the energy associated with the second phase-shifted input feed signal PSFn2 to an input of coupler $C_{22}$ and couple 10% of the energy associated with the second phase-shifted input feed signal PSFn2 to coupler $C_{12}$ where 90% of the coupled 10% signal will pass through termination resistor $R_{12}$ to ground (and lost) and 10% of the coupled 10% signal (i.e., 1%) will be provided to the output of $C_{12}$ (as a minor signal component of PSF2*n**). In a similar manner, 90% of the 90% PSF1***n* signal received at an input of coupler $C_{12}$ will be passed as "(0.81)PSF1*n*", the primary energy component of PSF2*n****, and 90% of the 90% PSF2***n* signal received at an input of coupler $C_{22}$ will be passed as "(0.81)PSF2*n*", the primary energy component of PSF1*n****. Based on this illustrated configuration, the power divider circuit 60***b* of FIG. 6B operates in a manner equivalent to the power divider circuit 30*b* of FIG. 3B, but with crisscrossed outputs.

Referring now to FIGS. 7A-7D, a four-way comparison is provided that demonstrates alternative techniques for driving a single array of radiating elements (e.g., low-band radiating elements) with a first plurality of radio frequency (RF) feed signals, which are derived from a first RF input feed signal that is generated by a RF transmitter (e.g., radio). As illustrated and described hereinabove with respect to FIG. 2, a plurality of phase-shifted feed signals PSF11-PSF15, PSF21-PSF25 may be generated by corresponding pluralities of phase shifters, which receive input feed signals from respective RF feed sources, including first and second radios (e.g., TX1, TX2).

Figures 7A, 7B, 7C, 7D:
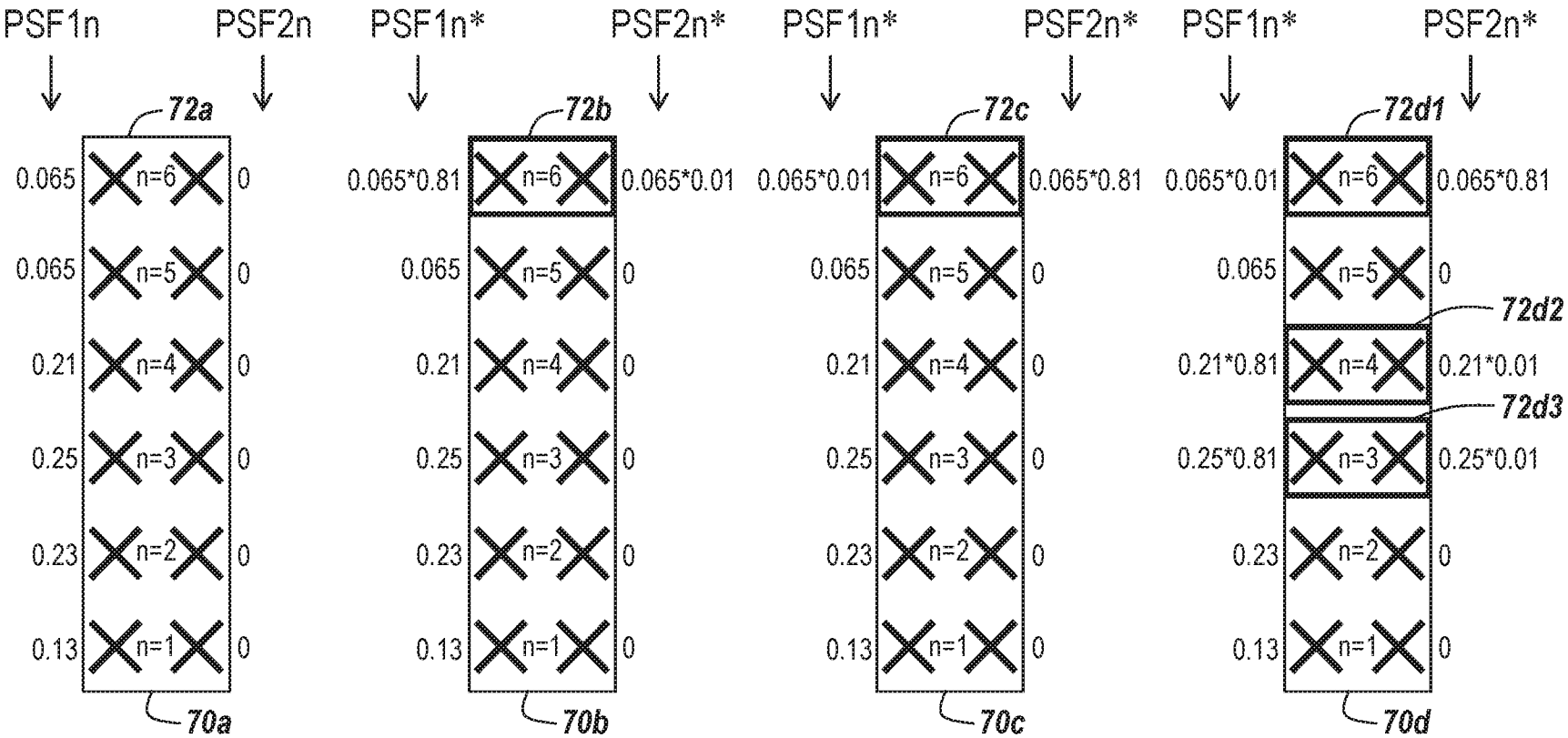
FIG. 7A is a plan view of left and right columns of low-band radiating elements within a base station antenna, which illustrates how a plurality of phase-shifted RF feed (PSF) signals derived from a first radio can be provided at different magnitudes to the left column of low-band radiating elements.
FIG. 7B is a plan view of left and right columns of low-band radiating elements within a base station antenna, which illustrates how a plurality of phase-shifted RF feed (PSF) signals derived from a first radio can be provided at different magnitudes to the left column of low-band radiating elements, and to a single radiating element in the right column of low-band radiating elements, according to embodiments of the present invention.
FIG. 7C is a plan view of left and right columns of low-band radiating elements within a base station antenna, which illustrates how a plurality of phase-shifted RF feed (PSF) signals derived from a first radio can be provided at different magnitudes to the left column of low-band radiating elements, and to a single radiating element in the right column of low-band radiating elements, according to embodiments of the present invention.
FIG. 7D is a plan view of left and right columns of low-band radiating elements within a base station antenna, which illustrates how a plurality of phase-shifted RF feed (PSF) signals derived from a first radio can be provided at different magnitudes to the left column of low-band radiating elements, and to three (3) radiating elements in the right column of low-band radiating elements, according to embodiments of the present invention.

In FIG. 7A, a plan view of left and right columns of radiating elements within a base station antenna 70*a* is provided, which illustrates how a first plurality of phase-shifted RF feed signals (PSF1*n*) derived from a first radio can be provided at different magnitudes (and different relative phases) to the left column of six (6) low-band radiating elements, and without any intervening power divider circuit (PDn) as shown by FIGS. 2, 3A and 6A. Based on this configuration, the relative magnitudes of the first plurality of phase-shifted RF feed signals (PSF1*n*) vary according to the following distribution (from the "lower" left radiating element in the left column to the "upper" left radiating element in the left column): PSF11=0.13, PSF11=0.23, PSF13=0.25, PSF14=0.21, PSF15=0.065, PSF16=0.065.

In contrast, in FIG. 7B, a plan view of left and right columns of radiating elements within a base station antenna 70*b* is provided, which illustrates how a first plurality of phase-shifted RF feed signals (PSF1*n*) derived from a first radio can be provided at different magnitudes to the left column of six (6) low-band radiating elements, and also to a single radiating element at the end of the second column of radiating elements, according to an embodiment of the invention. In particular, a corresponding left and right pair of radiating elements 72*b* at an "upper" end of the antenna 70*b* may be driven with a respective pair of reduced-power signals derived from phase-shifted RF feed signal PSF16, as modified by a single power divider circuit PDn 30*a* FIG. 3A, where PSF16=0.065, PSF16*=0.065×0.81 and PSF26*=0.065×0.01. (See also, PDn 30*b*, PDN 30*f* of FIGS. 3B, 3F). Thus, the feed signal driving example illustrated by FIG. 7B corresponds to the related techniques illustrated by FIGS. 4A-4C, but with only a single power divider circuit PDn (e.g., 30*a*, 30*b*, 30*f*) being utilized.

Next, as illustrated by FIG. 7C, a base station antenna 70*c* is provided, which illustrates how a first plurality of phase-shifted RF feed signals (PSF1*n*) derived from a first radio can be provided at different magnitudes to the left column of six (6) low-band radiating elements, and also to a single radiating element at the end of the second column of radiating elements, according to an embodiment of the invention. In particular, a corresponding left and right pair of radiating elements 72*c* at an "upper" end of the antenna 70*c* may be driven with a respective pair of reduced-power signals derived from phase-shifted RF feed signal PSF16, as modified by a single power divider circuit PDn 60*a*, 60*b* of FIGS. 6A-6B, where PSF16=0.065, PSF16*=0.065×0.01 and PSF26*=0.065×0.81. Thus, the feed signal driving example illustrated by FIG. 7C differs from the feed signal driving example illustrated by FIG. 7B, by reversing the magnitudes of the signals (0.81 v. 0.01) provided between the left and right radiating elements in the pair 72*c* relative to the pair 72*b*, as shown. Based on this configuration, a 600 MHz antenna (frequency band from 617 MHz to 896 MHz) may be provided using the same 498 mm housing as an RRVV antenna (e.g., 698 MHz-960 MHz); the base station antennas 70*a*, 70*b* and 70*c* of FIGS. 7A-7C may have widths of 498 mm and lengths of 1828 mm.

Finally, as illustrated by FIG. 7D, a base station antenna 70*d* is provided, which demonstrates how the first power divider circuit (30*a*, 30*b*, 30*f*) of FIGS. 3A-3B and 3F may be combined with the second power divider circuit (60*a*, 60*b*) of FIGS. 6A-6B, to achieve further HPBW narrowing according to an embodiment of the invention. As shown, a first pair of side-by-side radiating elements 72*d*1 at the end of the first and second columns of radiating elements may receive signals from the second power divider circuit (60*a*, 60*b*), whereas two other pairs of side-by-side radiating elements 72*d*2, 72*d*3 may receive signals from corresponding first power divider circuits (30*a*, 30*b*, 30*f*).

Figure 8:
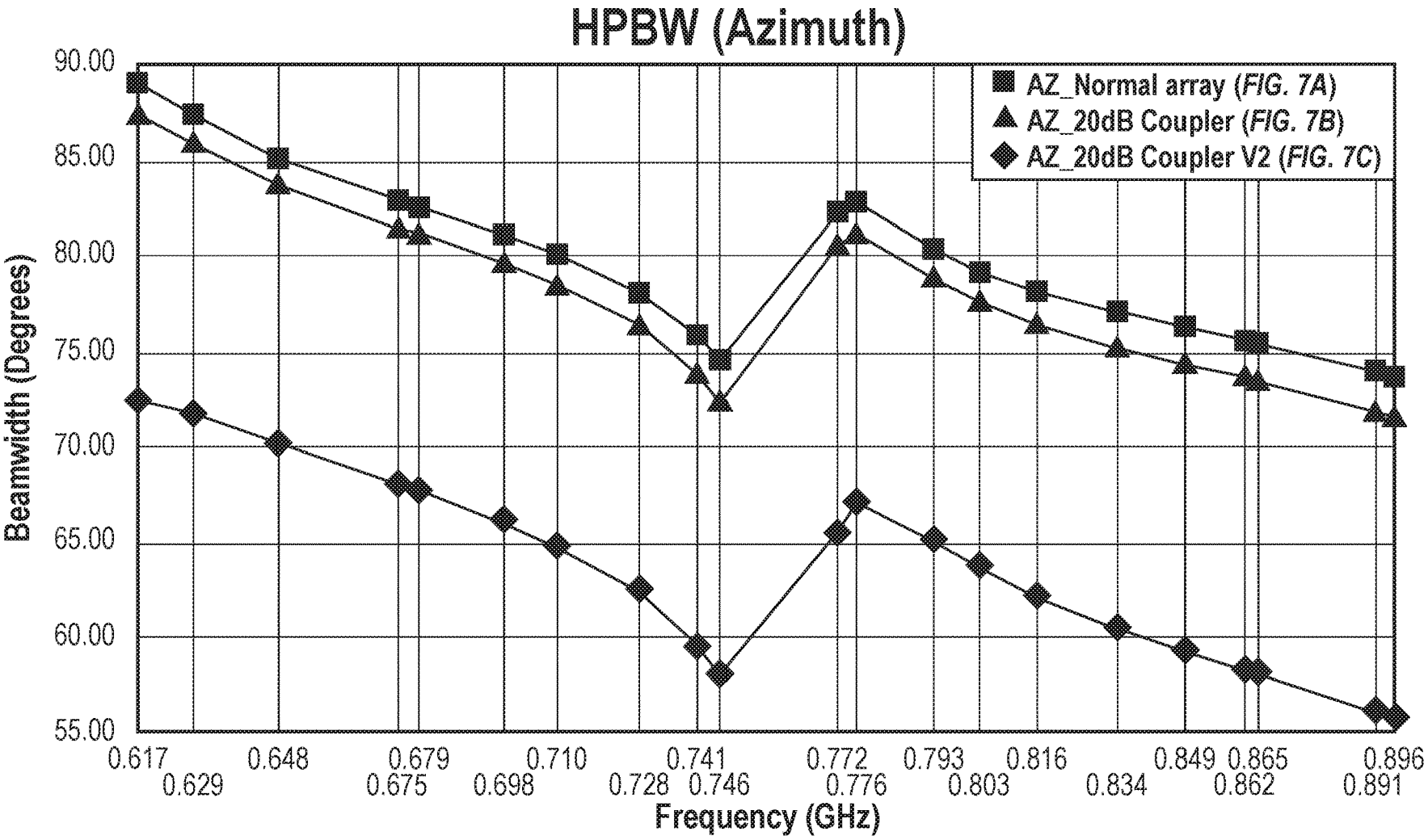
FIG. 8 is a graph comparing a−3 dB beamwidth (HPBW) as a function of frequency (GHz), for the low-band radiating element arrays of FIGS. 7A-7C.

Referring now to FIG. 8, a graph is provided, which compares the relative half-power beamwidths (HPBW) (y-axis) as a function of frequency (x-axis) between the embodiments of FIGS. 7A-7B, where a relatively small reduction in HPBW (≈2°) is achieved by using a single power divider circuit PDn (see, e.g., 30*a*, 30*b*, 30*f* of FIGS. 3A, 3B and 3F) at the end of the antenna 70*b*, but a relatively large reduction in HPBW (≈16°) is achieved by using a single "reversed-output" power divider circuit PDn (see, e.g., 60*a*, 60*b* of FIGS. 6A-6B) at the end of the antenna 70*c*.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. An antenna array, comprising:

first and second columns of radiating elements responsive to a first plurality of radio frequency (RF) feed signals derived from a first radio and a second plurality of RF feed signals derived from a second radio, respectively; and a first power divider circuit configured to drive a first one of the radiating elements in the second column of radiating elements with a majority of the energy associated with a first one of the first plurality of RF feed signals, and drive a first one of the radiating elements in the first column of radiating elements with a non-zero minority of the energy associated with the first one of the first plurality of RF feed signals.

2. The antenna array of claim 1, wherein the first one of the radiating elements in the first column of radiating elements extends opposite the first one of the radiating elements in the second column of radiating elements.

3. The antenna array of claim 2, wherein said first power divider circuit is further configured to drive the first one of the radiating elements in the first column of radiating elements with a majority of the energy associated with a first one of the second plurality of RF feed signals, and drive the first one of the radiating elements in the second column of radiating elements with a non-zero minority of the energy associated with the first one of the second plurality of RF feed signals.

4. The antenna array of claim 3, further comprising:

a second power divider circuit configured to drive a second one of the radiating elements in the first column of radiating elements with a majority of the energy associated with a second one of the first plurality of RF feed signals, and drive a second one of the radiating elements in the second column of radiating elements with a non-zero minority of the energy associated with the second one of the first plurality of RF feed signals.

5. The antenna array of claim 4, wherein said second power divider circuit is further configured to drive the second one of the radiating elements in the second column of radiating elements with a majority of the energy associated with a second one of the second plurality of RF feed signals, and drive the second one of the radiating elements in the first column of radiating elements with a non-zero minority of the energy associated with the second one of the second plurality of RF feed signals.

6. The antenna array of claim 3, wherein a second one of the radiating elements in the first column of radiating elements receives all of the energy associated with a second one of the first plurality of RF feed signals; and wherein a second one of the radiating elements in the second column of radiating elements receives all of the energy associated with a second one of the second plurality of RF feed signals.

7. The antenna array of claim 1, further comprising:

a first phase shifter configured to generate the first plurality of RF feed signals, which are phase shifted relative to each other, in response to a first RF input feed signal generated by the first radio; and a second phase shifter configured to generate the second plurality of RF feed signals, which are phase shifted relative to each other, in response to a second RF input feed signal generated by the second radio.

8. An antenna array, comprising:

first and second arrays of radiating elements responsive to a first plurality of radio frequency (RF) feed signals derived from a first RF transmitter and a second plurality of RF feed signals derived from a second RF transmitter, respectively; and a first power divider circuit configured to drive: (i) a first one of the radiating elements in the second array of radiating elements with a majority of the energy associated with a first one of the first plurality of RF feed signals, (ii) a first one of the radiating elements in the first array of radiating elements with a non-zero minority of the energy associated with the first one of the first plurality of RF feed signals, (iii) the first one of the radiating elements in the first array of radiating elements with a majority of the energy associated with a first one of the second plurality of RF feed signals, and (iv) the first one of the radiating elements in the second array of radiating elements with a non-zero minority of the energy associated with the first one of the second plurality of RF feed signals.

9. The antenna array of claim 8, wherein a second one of the radiating elements in the first array of radiating elements receives all of the energy associated with a second one of the first plurality of RF feed signals; and wherein a second one of the radiating elements in the second array of radiating elements receives all of the energy associated with a second one of the second plurality of RF feed signals.

10. The antenna array of claim 8, further comprising:

a second power divider circuit configured to drive a second one of the radiating elements in the first array of radiating elements with a majority of the energy associated with a second one of the first plurality of RF feed signals, and drive a second one of the radiating elements in the second array of radiating elements with a non-zero minority of the energy associated with the second one of the first plurality of RF feed signals.

11. The antenna array of claim 9, wherein the first and second arrays of radiating elements are respective first and second linear arrays of radiating elements.

12. An antenna array, comprising:

a first plurality of radiating elements in a first column, which are responsive to a first plurality of RF feed signals derived from a first radio;

a second plurality of radiating elements in a second column, which are responsive to a second plurality of RF feed signals derived from a second radio; and a power divider circuit configured to drive a first one of the radiating elements at a first end of the second column of radiating elements with a majority of the energy associated with a first one of the first plurality of RF feed signals, and drive a first one of the radiating elements at a first end of the first column of radiating elements with a non-zero minority of the energy associated with the first one of the first plurality of RF feed signals.

13. The antenna array of claim 12, wherein said first power divider circuit is further configured to drive the first one of the radiating elements in the first column of radiating elements with a majority of the energy associated with a first one of the second plurality of RF feed signals, and drive the first one of the radiating elements in the second column of radiating elements with a non-zero minority of the energy associated with the first one of the second plurality of RF feed signals.

14. The antenna array of claim 13, wherein a second one of the radiating elements in the first column of radiating elements is driven with all of the energy associated with a second one of the first plurality of RF feed signals and none of the energy associated with a second of the second plurality of RF feed signals; and wherein a second one of the radiating elements in the second column of radiating elements is driven with all of the energy associated with a second one of the second plurality of RF feed signals and none of the energy associated with a second of the first plurality of RF feed signals.

15. The antenna array of claim 13, wherein a second one of the radiating elements at a second end of the first column of radiating elements is driven with all of the energy associated with a second one of the first plurality of RF feed signals and none of the energy associated with a second of the second plurality of RF feed signals; and wherein a second one of the radiating elements at a second end of the second column of radiating elements is driven with all of the energy associated with a second one of the second plurality of RF feed signals and none of the energy associated with a second of the first plurality of RF feed signals.

16. The antenna array of claim 13, wherein said power divider circuit comprises a first cascaded pair of power dividers cross-coupled with a second cascaded pair of power dividers.

17. The antenna array of claim 16, wherein each of the first cascaded pair of power dividers and each of the second cascaded pair of power dividers is selected from a group consisting of directional couplers, branch line couplers, Wilkinson power dividers and reactive T-splitters, and combinations thereof.

18. The antenna array of claim 16, wherein the first cascaded pair of power dividers is configured to drive the first one of the radiating elements at the first end of the second column of radiating elements with 70-90 percent of the energy associated with the first one of the first plurality of RF feed signals, and drive the first one of the radiating elements at the first end of the first column of radiating elements with 0.26-2.7 percent of the energy associated with the first one of the first plurality of RF feed signals.

19. The antenna array of claim 18, wherein the second cascaded pair of power dividers is configured to drive the first one of the radiating elements in the first column of radiating elements with 70-90 percent of the energy associated with the first one of the second plurality of RF feed signals, and drive the first one of the radiating elements in the second column of radiating elements with 0.26-2.7 percent of the energy associated with the first one of the second plurality of RF feed signals.

20. The antenna array of claim 19, further comprising:

a second power divider circuit configured to drive a second one of the radiating elements in the first array of radiating elements with a majority of the energy associated with a second one of the first plurality of RF feed signals, and drive a second one of the radiating elements in the second array of radiating elements with a non-zero minority of the energy associated with the second one of the first plurality of RF feed signals.

* * * * *